US012078174B2

(12) United States Patent
Cui et al.

(10) Patent No.: US 12,078,174 B2
(45) Date of Patent: Sep. 3, 2024

(54) SCROLL COMPRESSOR

(71) Applicant: Copeland Climate Technologies (Suzhou) Co. Ltd., Jiangsu (CN)

(72) Inventors: Yonghua Cui, Suzhou (CN); Yong Luo, Suzhou (CN); Long Zheng, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 179 days.

(21) Appl. No.: 17/606,726

(22) PCT Filed: Nov. 29, 2019

(86) PCT No.: PCT/CN2019/121963
§ 371 (c)(1),
(2) Date: Oct. 26, 2021

(87) PCT Pub. No.: WO2020/215723
PCT Pub. Date: Oct. 29, 2020

(65) Prior Publication Data

US 2022/0235774 A1 Jul. 28, 2022

(30) Foreign Application Priority Data

Apr. 26, 2019 (CN) ..... 201920591213.4

(51) Int. Cl.
*F04C 29/12* (2006.01)
*F04C 18/02* (2006.01)

(52) U.S. Cl.
CPC ..... *F04C 29/12* (2013.01); *F04C 18/0207* (2013.01)

(58) Field of Classification Search
CPC ..... F04C 18/0215; F04C 18/0207; F04C 18/0261; F04C 18/02; F04C 18/027;
(Continued)

(56) References Cited

U.S. PATENT DOCUMENTS 5,088,905 A 2/1992 Beagle
5,674,061 A 10/1997 Motegi et al.
(Continued)

FOREIGN PATENT DOCUMENTS

CN 1224805 A 8/1999
CN 203770087 U 8/2014
(Continued)

OTHER PUBLICATIONS

Machine Translation CN 208294771 (Year: 2023).*
(Continued)

*Primary Examiner* — Dapinder Singh
(74) *Attorney, Agent, or Firm* — Harness, Dickey & Pierce, P.L.C.

(57) ABSTRACT

Provided is a scroll compressor, comprising a compression mechanism and a valve assembly. The compression mechanism is provided with a vent, and the valve assembly is used for selectively opening and closing the vent. The valve assembly comprises a valve plate and at least one valve piece. The valve plate comprises at least one valve orifice; and the valve piece is configured to selectively open and close the valve orifice. The scroll compressor further comprises a guide passageway. The guide passageway is provided with a first port communicating with the valve orifice and a second port communicating with the exhaust opening. The valve assembly and the compressor can significantly prolong the service life of the valve piece, and can provide good guidance for a fluid discharged from the compression mechanism, thereby significantly reducing the resistance of venting and the fluid pressure drop, and improving the effect of venting.

14 Claims, 8 Drawing Sheets

(58) Field of Classification Search
CPC ..... F04C 28/24; F04C 28/14; F04C 28/16; F04C 28/12; F04C 28/10; F04C 23/008; F04C 29/12; F04C 29/128; F04C 29/028; F04C 29/124; F04C 29/126; F04C 2250/102
See application file for complete search history.

(56) References Cited

U.S. PATENT DOCUMENTS

| | | | | |
|---|---|---|---|---|
| 6,102,682 | A * | 8/2000 | Kim | F04C 29/0035 418/270 |
| 10,400,772 | B2 * | 9/2019 | Sun | F04C 29/128 |
| 11,326,598 | B2 * | 5/2022 | Oka | F16K 15/16 |
| 2002/0012595 | A1 | 1/2002 | Kouno et al. | |
| 2009/0142214 | A1 | 6/2009 | Furusho et al. | |
| 2015/0176585 | A1 * | 6/2015 | Sun | F04C 29/128 137/493 |

FOREIGN PATENT DOCUMENTS

| | | | |
|---|---|---|---|
| CN | 206175209 | U | 5/2017 |
| CN | 208294771 | U | 12/2018 |
| EP | 3015710 | A1 | 5/2016 |
| JP | H04262089 | A | 9/1992 |
| JP | 2015031206 | A | 2/2015 |
| WO | WO-2006126531 | A1 | 11/2006 |

OTHER PUBLICATIONS

International Search Report (English and Chinese) and Written Opinion (Chinese) of the International Searching Authority issued in PCT/CN2019/121963, dated Feb. 19, 2020; ISA/CN (9 pages).
Extended European Search Report dated Dec. 5, 2022, in corresponding European Application No. 19926306.2.

* cited by examiner

SCROLL COMPRESSOR

This application is the national phase of International Application No. PCT/CN2019/121963 titled "SCROLL COMPRESSOR" and filed on Nov. 29, 2019, which claims the priority to the Chinese Patent Application No. 201920591213.4 titled "SCROLL COMPRESSOR" and filed with the Chinese National Intellectual Property Administration on Apr. 26, 2019. The entire disclosures of the patent applications listed above are incorporated herein by reference.

FIELD

The disclosure relates to a scroll compressor, and in particular to a scroll compressor improved in the exhaust valve assembly of the compression mechanism.

BACKGROUND

This section provides background information relating to the disclosure, which may not necessarily constitute the conventional technology.

A compressor (such as a scroll compressor, etc.) may be applied, for example, in a refrigeration system, an air conditioning system, and a heat pump system. During the working process of the compressor, the compression mechanism intakes low pressure fluid from the low pressure area in the compressor and compresses the intake low pressure fluid. The compressed high pressure fluid is discharged into the high pressure area in the compressor through the exhaust port of the compression mechanism. A one-way exhaust valve assembly is usually provided at the exhaust port of the compression mechanism. The valve assembly includes a valve hole in fluid communication with the exhaust port and a valve piece for closing the valve hole. The valve piece keeps covering the valve hole in a normal state and opens the valve hole when the pressure in the exhaust port reaches a predetermined pressure value—for example, the valve piece is forced to elastically deform and move away from the valve hole. When the pressure in the exhaust port is less than the predetermined pressure value, the valve piece covers the valve hole again, thereby maintaining the high pressure state in the high pressure area.

However, in practical applications, it is found that the existing valve assembly may have the following technical problems: due to the small cross-sectional area of the valve hole, the valve piece moves at a high speed, which may shorten the life of the valve piece; and as the number of valve holes is different from the number of exhaust ports and/or the valve holes are not aligned with the exhaust ports, the fluid flow resistance increases, which leads to a large pressure drop as the fluid flows through the valve assembly, which may also lead to the instability of the exhaust process. Especially for compressors with high displacement, the problems may be more significant.

Therefore, it is necessary to provide a scroll compressor which improves the exhaust of the compression mechanism and prolongs the service life of the exhaust valve assembly.

SUMMARY

In this section, a general summary of the present disclosure, rather than a full disclosure of the full scope or all features of the present disclosure, is provided.

An object of the disclosure is to provide improvement in terms of one or more technical problems mentioned above.

In general, a scroll compressor is provided according to the disclosure, which significantly improves the exhaust of the compression mechanism and prolongs the service life of the exhaust valve assembly.

A scroll compressor is provided according to an aspect of the disclosure, comprising:

a compression mechanism provided with an exhaust port; and a valve assembly being used to selectively open and close the exhaust port, and the valve assembly comprising:

a valve plate comprising at least one valve hole; and at least one valve piece configured to selectively open and close the valve hole, characterized in that: the scroll compressor further comprises a guide passage which has a first port communicating with the valve hole and a second port communicating with the exhaust port.

By providing at least one valve hole and at least one valve piece, the cross-sectional area of the fluid passage is further enlarged, Therefore, under the condition that the valve piece is far away from the valve hole by the same distance, more fluid is discharged, so that the opening degree and the moving speed of the valve piece are reduced, and the service life of the valve piece is significantly prolonged. By providing the above-mentioned guide passage, it is convenient to provide a guide for the fluid from the exhaust port of the compression mechanism, and is beneficial to reducing the exhaust resistance and mitigating the pressure drop as the fluid flows through the valve hole, improving the stability of the exhaust airflow and further improving the exhaust effect.

According to an aspect of the disclosure, the flow area of the second port and the flow area of the first port are not equal. This arrangement is beneficial to adaptively adjusting the flow areas of the second port and the first port according to the size of the exhaust port of the compression mechanism and the valve hole of the valve plate. When the flow areas of the exhaust port and the valve hole (or the sum of multiple valve holes) are not equal to each other, it may be set that the flow area of the second port and the flow area of the first port are not equal.

According to an aspect of the disclosure, the guide passage is configured as a tapered guide passage that tapers from the second port to the first port. In view of the situation where the exhaust port of the compression mechanism is significantly larger than at least one valve hole on the valve plate, and by providing such a tapered guide passage that tapers from the second port to the first port, it is possible to advantageously transition from an exhaust port with a larger cross-sectional area to at least one valve hole with a smaller cross-sectional area, which is beneficial to reducing the exhaust resistance and moderately guiding the fluid to the at least one valve hole, thereby further improving the exhaust effect.

According to an aspect of the disclosure, an inner wall of the guide passage is at least partially continuously inclined with respect to a longitudinal direction of the scroll compressor.

According to an aspect of the disclosure, the inner wall of the guide passage has a locally stepped or curved concave-convex structure.

According to an aspect of the disclosure, an area of the first port is greater than or equal to an area of the valve hole, and/or an area of the second port is greater than or equal to an area of the exhaust port. This is beneficial to completely guiding the fluid from the exhaust port to the valve hole of the valve assembly.

According to an aspect of the disclosure, the second port and the first port are aligned with each other in the longitudinal direction of the scroll compressor; or, the second port and the first port are not aligned with each other in the longitudinal direction of the scroll compressor.

Particularly, in view of the situation where the exhaust port of the compression mechanism and the valve hole of the valve assembly in the conventional technology are not aligned with each other in the longitudinal direction of the scroll compressor, in order to better guide the fluid from the exhaust port into the valve hole, the second port is preferably arranged to be aligned with the exhaust port, and the first port is aligned with the valve hole. As a result, the second port is offset relative to the first port. This design further reduces the exhaust resistance and mitigates the pressure drop when the fluid flows through the valve hole, thereby significantly improving the stability of the exhaust air flow and further improving the exhaust effect.

According to an aspect of the disclosure, the first port includes at least one first orifice, and the number of the at least one first orifice corresponds to the number of the at least one valve hole; or, the first port includes at least one first orifice different in number from the at least one valve hole.

Specifically, the number of the first orifices may be greater or smaller than the number of the valve holes as long as the fluid can be delivered into the valve holes. For example, one first orifice may correspond to at least two valve holes, or at least two first orifices may correspond to one valve hole.

According to an aspect of the disclosure, the second port includes at least one second orifice, and the number of the at least one second orifice is the same as the number of the at least one first orifice; or, the second port includes at least one second orifice different in number from the at least one first orifice.

Specifically, the number of the second orifices may be greater or smaller than the number of the first orifices. For example, two channels may extend from the same first orifice and extend to two or more different second orifices; or, two or more channels extending from different first orifices may extend and converge to the same second orifice.

According to an aspect of the disclosure, preferably, the first port includes two first orifices, and the second port includes one second orifices; the valve plate includes two valve holes respectively communicating with the two first orifices; the guide passage is configured as a tapered guide passage that tapers from the second orifice to the first orifice.

According to an aspect of the disclosure, the scroll compressor includes a guide member provided between the valve plate and the exhaust port, and the guide passage is provided in the guide member.

By arranging a guide member independent from the valve plate, it is convenient to set the configuration of the guide passage more flexibly. For example, for the valve plate with the same configuration including the at least one valve hole, when being applied to different types of compressors, the position and/or size of the exhaust port of the compression mechanism relative to the valve hole may be different. In this case, the guide member may be adapted to different types of compressors by replacing the guide member or simply modifying the guide member, which greatly reduces the cost and saves labor.

According to an aspect of the disclosure, the valve assembly is disposed in a concave portion defined by a hub portion of the fixed scroll end plate of the compression mechanism, an inner side wall of the hub portion is provided with a shape fitting portion that matches the positioning indicating portion on an outer circumference of the guide member in a manner of one-to-one correspondence.

According to an aspect of the disclosure, the positioning indicating portion includes at least two convex portions arranged in non-centrosymmetric way along the outer circumference of the guide member, the shape fitting portion includes at least two grooves.

The guide member is positioned in the circumferential direction by providing such a positioning indicating portion, and the guide member is prevented from being mounted to the scroll compressor in an inverted state (incorrectly fitted). For example, preferably at least two convex portions may be provided in non-centrosymmetric way along the outer circumference of the guide member. Since the at least two convex portions are not centrally symmetric with each other, when an operator tries to mount the guide member to the scroll compressor in an inverted state (incorrectly fitted), at least one of the at least two convex portions may hinder the installation of the guide member. In addition, at least one positioning indicating portion with other irregular shapes may also be used. For example, in a case where only one positioning indicating portion is provided, the positioning indicating portion itself may have a non-centrosymmetric shape, and may be a convex portion or a concave portion. Correspondingly, the concave portion formed by the hub portion of the scroll compressor has the concave portion or convex portion which is matched in shape and is also non-centrosymmetric. In this way, when the operator tries to mount the guide member to the concave portion in an overturned state (incorrectly fitted), as the positioning indicating portion (and the shape fitting portion in the concave portion) itself has a non-centrosymmetric shape, the positioning indicating portion and the shape fitting portion collide with each other, so that the guide member cannot be mounted in the scroll compressor. Therefore, the guide member is effectively prevented from being mounted incorrectly and affecting the exhaust effect.

According to an aspect of the disclosure, the number of the valve holes is at least two, and the number of the valve pieces is equal to the number of the valve holes, so that one of the valve pieces covers respective one of the valve holes. This arrangement is beneficial to reducing the movement speed of the valve piece, thereby prolonging the life of the valve piece.

According to an aspect of the disclosure, at least one valve stop is further fixed on the valve plate, the valve stop is located on the side of the valve piece facing away from the valve plate and has a gap with the valve piece to define the distance of the valve piece away from the valve hole.

In summary, the scroll compressor according to the disclosure provides at least the following beneficial effects: The scroll compressor according to the disclosure provides a valve hole with a larger fluid passage cross-sectional area in the valve assembly, so that more fluid may be discharged when the valve plate is at the same distance away from the valve hole, thereby reducing the opening degree and moving speed of the valve piece, significantly prolonging the life of the valve piece. By arranging the tapered guide passage, a guide is provided for the discharged fluid from the compression mechanism, thereby remarkably reducing the exhaust resistance and mitigating the pressure drop of fluid, improving the exhaust stability and the exhaust effect.

BRIEF DESCRIPTION OF THE DRAWINGS

The foregoing and additional features and characteristics of the disclosure will become more apparent from the following detailed description with reference to the accompanying drawings, which are merely examples and are not necessarily drawn to scale. Same reference numerals in the drawings indicate same parts. In the drawings:

FIG. 2*a* to FIG. 2*b* respectively show the valve assembly of conventional technology in FIG. 1, in which, FIG. 2*a* shows a sectional perspective view of a valve assembly of conventional technology in an assembled state; FIG. 2*b* shows a perspective view of the valve assembly of conventional technology in an exploded state.

FIG. 3*a* to FIG. 3*b* respectively show the valve assembly in the scroll compressor according to the first preferred embodiment of the disclosure, in which, FIG. 3*a* shows a longitudinal cross-sectional view of the valve assembly mounted in the scroll compressor in an assembled state; FIG. 3*b* shows a perspective view of the valve assembly in an exploded state.

FIG. 4*a* to FIG. 4*c* respectively show the guide member in FIG. 3*b*, in which, FIG. 4*a* shows a perspective view of the guide member; FIG. 4*b* shows a longitudinal cross-sectional view of the guide member in FIG. 4*a* taken along the line A-A; FIG. 4*c* shows an A-A cross-sectional view of the assembly of the guide member in FIG. 4*b* and the valve plate.

FIG. 5*a* to FIG. 5*f* respectively show a guide member in a valve assembly in a scroll compressor according to a second preferred embodiment of the disclosure, in which, FIG. 5*a* shows a perspective view of the guide member; FIG. 5*b* shows a longitudinal cross-sectional view of the guide member in FIG. 5*a* taken along the line A-A; FIG. 5*c* and FIG. 5*d* show a perspective view of the assembly of the guide member in FIG. 5*b* and the valve plate; FIG. 5*e* shows a plan view of the guide member in FIG. 5*b* and the valve plate assembled together; FIG. 5*f* shows an A-A cross-sectional view of the guide member in FIG. 5*b* and the valve plate assembled together.

FIG. 6*a* to FIG. 6*c* respectively show a guide member in a valve assembly in a scroll compressor according to a third preferred embodiment of the disclosure, in which, FIG. 6*a* shows a perspective view of the guide member; FIG. 6*b* shows a plan view of the guide member in FIG. 6*a*; FIG. 6*c* shows a longitudinal cross-sectional view of the guide member in FIG. 6*b* taken along the line A-A.

FIG. 7*a* to FIG. 7*d* respectively show the guide member in FIG. 3*b*, in which, the positioning indicating portion of the guide member and its fitting in the scroll compressor are shown, in which, FIG. 7*a* shows a schematic plan view of the guide member; FIG. 7*b* shows a situation where the guide member in FIG. 7*a* is correctly fitted in the scroll compressor; FIG. 7*c* shows a schematic diagram of the guide member in FIG. 7*a* being incorrectly fitted in the scroll compressor, in which, the guide member is misaligned in the circumferential direction in the scroll compressor; FIG. 7*d* shows a schematic diagram of the guide member in FIG. 7*a* being incorrectly fitted in the scroll compressor, in which, the guide member is turned over and assembled in the scroll compressor.

Figure 1:
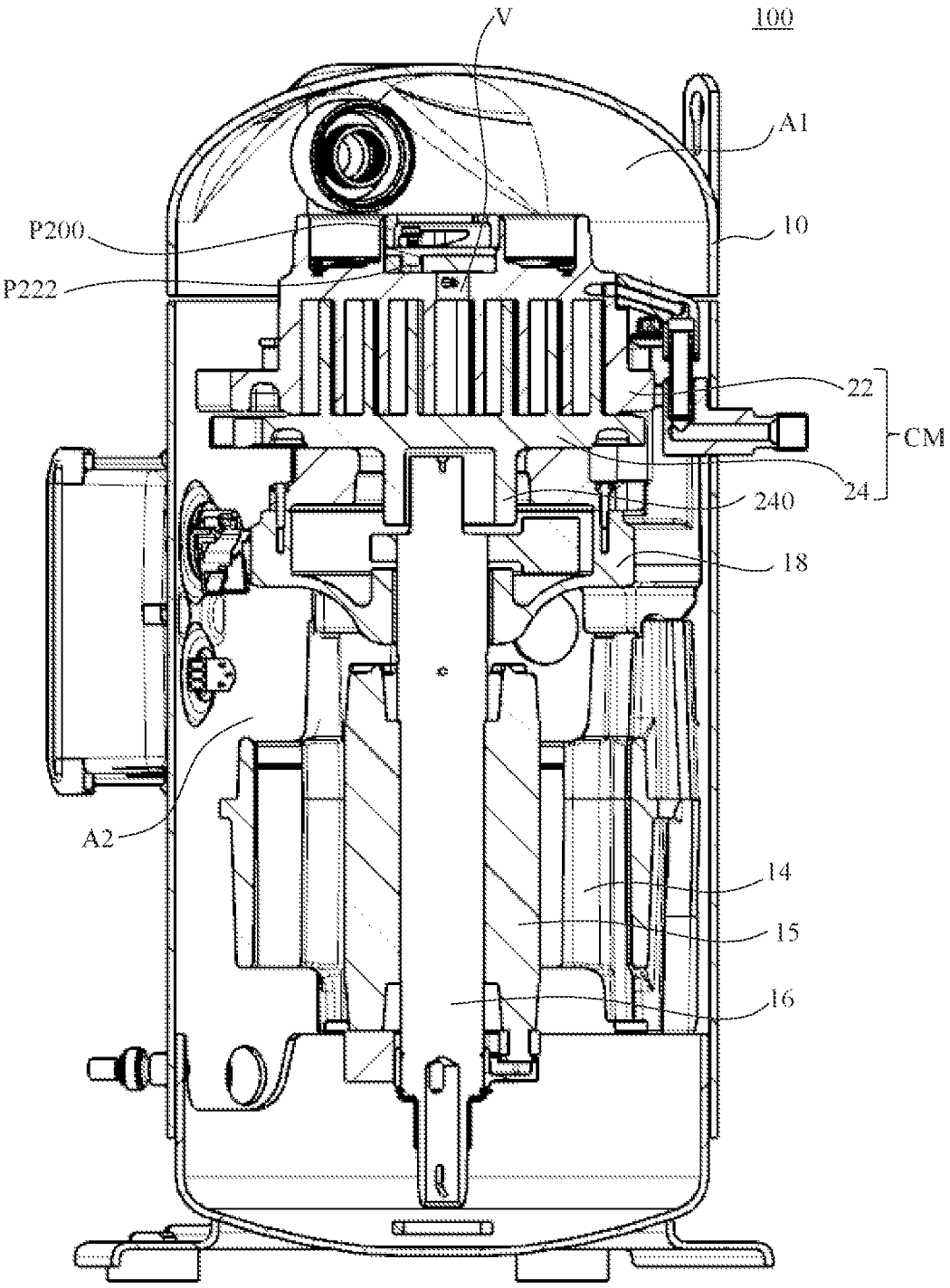
FIG. 1 shows a longitudinal sectional view of a scroll compressor in conventional technology, in which the arrangement of a valve assembly of conventional technology in the scroll compressor is shown.

REFERENCE MARK LIST scroll compressor 100; housing 10; drive shaft 16; main bearing seat 18; hub portion 240;

stator 14; rotor 15; compression mechanism CM; fixed scroll 22; movable scroll 24;

valve assembly P200 of conventional technology; valve plate P220 of conventional technology;

valve hole P222 of conventional technology; valve piece P224 of conventional technology;

valve assembly 200; valve plate 220; valve hole 222; valve piece 224; guide passage L;

channel G; the first orifice L10; the second orifice L20; the first port L1; the second port L2;

guide member 240; positioning indicating portion S; shape fitting portion T; valve stop 226;

compression mechanism CM; exhaust port V; concave portion R.

DETAILED DESCRIPTION OF THE EMBODIMENTS

The preferred embodiments of the disclosure will now be described in detail with reference to FIG. 1 to FIG. 7*d*. The following description is merely exemplary in nature and is not intended to limit the disclosure and the application or use thereof.

In the following exemplary embodiments, for ease of description, a vertical scroll compressor is taken as an example. However, the scroll compressor according to the disclosure may also be any other suitable type of scroll compressor, such as a horizontal scroll compressor.

FIG. 1 shows a longitudinal sectional view of a scroll compressor in conventional technology. First, an overall structure of the scroll compressor is briefly described with reference to FIG. 1.

As shown in FIG. 1, the scroll compressor 100 may include a housing 10, an electric motor (including a stator 14 and a rotor 15), a drive shaft 16, a main bearing seat 18, a movable scroll 24, and a fixed scroll 22. The movable scroll 24 and the fixed scroll 22 constitute a compression mechanism CM suitable for compressing a working fluid (for example, refrigerant), wherein the fixed scroll 22 includes a fixed scroll end plate, a fixed scroll wrap and an exhaust port V located at the center of the fixed scroll; the movable scroll 24 includes a movable scroll end plate, a movable scroll wrap and a hub portion 240, an open suction chamber in fluid communication with the intake port of the compression mechanism CM is defined in the compression mechanism CM; and a series of closed compression chambers formed by engaging the fixed scroll wrap and the movable scroll wrap for compressing the working fluid are defined in the compression mechanism CM. A high pressure area A1 and a low pressure area A2 isolated from each other are defined in the housing 10.

The electric motor includes a stator 14 and a rotor 15. The rotor 15 is used to drive the drive shaft 16, so as to rotate the drive shaft 16 about its rotation axis relative to the housing 10. The movable scroll 24 is driven by an electric motor via the drive shaft 16, so that it may perform translational rotation, that is, orbiting, with respect to the fixed scroll 22 by means of an oldham (that is, the axis of the movable scroll 24 revolves relative to the axis of the fixed scroll 22, but both of the movable scroll 24 and the fixed scroll 22 do not rotate around their respective axes). Thus, the intake port of the compression mechanism CM draws in low pressure fluid from the low pressure area A2, compresses the fluid through the series of closed compression chambers, and discharges the high pressure fluid through the exhaust port V.

After the compression mechanism CM discharges high pressure fluid through the exhaust port V, the pressure in the chamber communicating with the exhaust port V in the compression mechanism CM drops, and the high pressure fluid in the high pressure area A1 tends to flow backward into the compression mechanism CM, which leads to the problem that the efficiency of the compression mechanism CM is reduced due to repeated compression. In order to solve this problem, a one-way valve assembly is usually provided at the exhaust port V of the compression mechanism CM to open and close the exhaust port V.

Figure 2A:
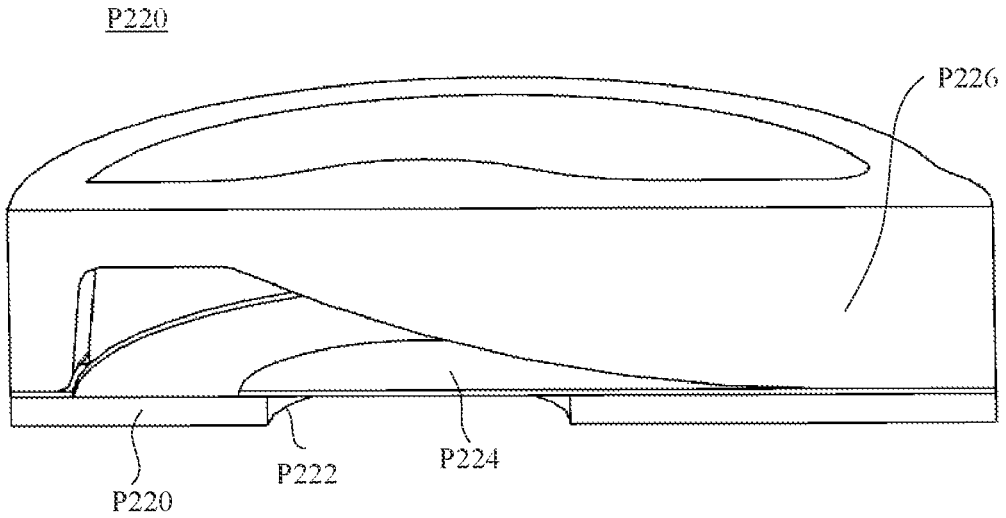
Figure 2B:
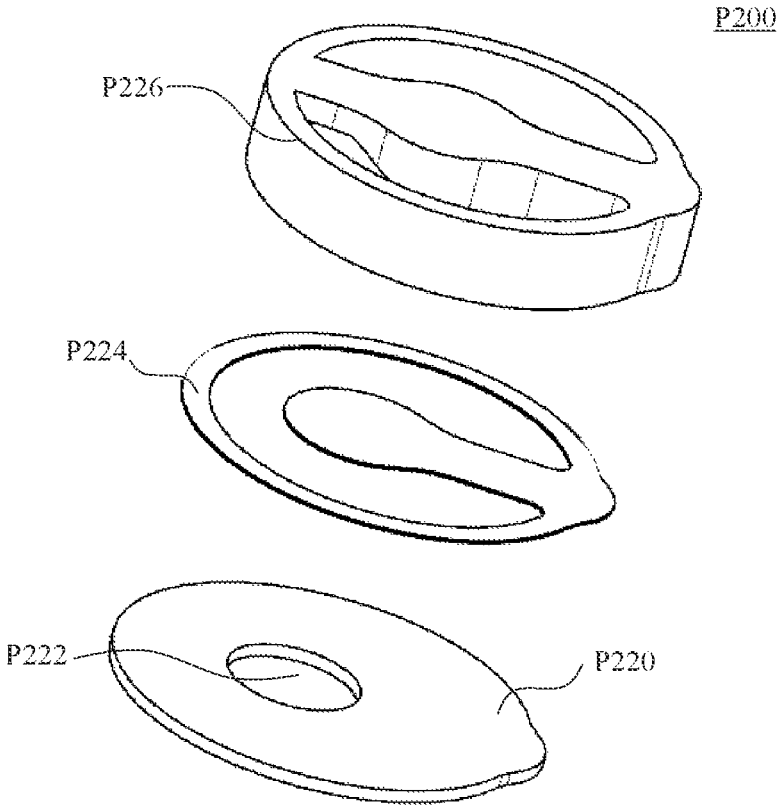

The valve assembly P200 of conventional technology is described below with reference to FIG. 2*a* and FIG. 2*b*. As shown in the figures, the valve assembly P200 of conventional technology includes: a valve plate P220, a valve piece P224 and valve stop P226, wherein the valve plate P220 includes a valve hole P222 in the shape of a vertical through hole. When the valve plate P220, the valve piece P224 and the valve stop P226 are assembled into the valve assembly P200 and mounted in the scroll compressor 100, it can be clearly seen from FIG. 1 that there is usually a certain lateral offset (longitudinal misalignment) between the valve hole P222 and the exhaust port V, and there is no component or structure that guides the flow between the valve hole P222 and the exhaust port V, and this may lead to an increase in the flow resistance of the fluid flowing from the exhaust port V to the valve hole P222, which in turn leads to a larger pressure drop when the fluid flows through the valve assembly, and eventually leads to the instability of the exhaust process and the movement of the valve piece P224. And as shown in the figures, the valve assembly P200 of conventional technology only includes a small valve hole P222, and because the cross-sectional area of the valve hole P222 is small, it may cause the valve piece P224 to move at a relatively high speed. As a result, the life of the valve piece P224 may be shortened, and these problems may be more significant in a high displacement compressor.

In order to solve the above technical problems, an improved valve assembly and a scroll compressor including the valve assembly are provided according to the disclosure.

The valve assembly in the scroll compressor according to the disclosure and its installation in the scroll compressor are described in detail below with reference to FIG. 3*a* to FIG. 7*d*.

Figure 3A:
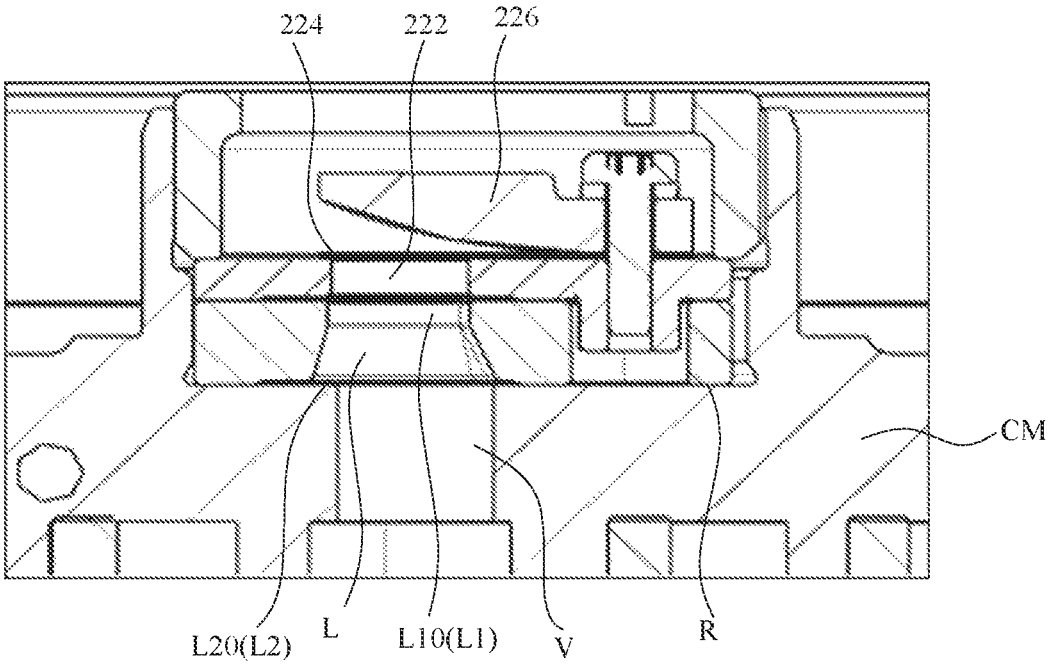
Figure 3B:
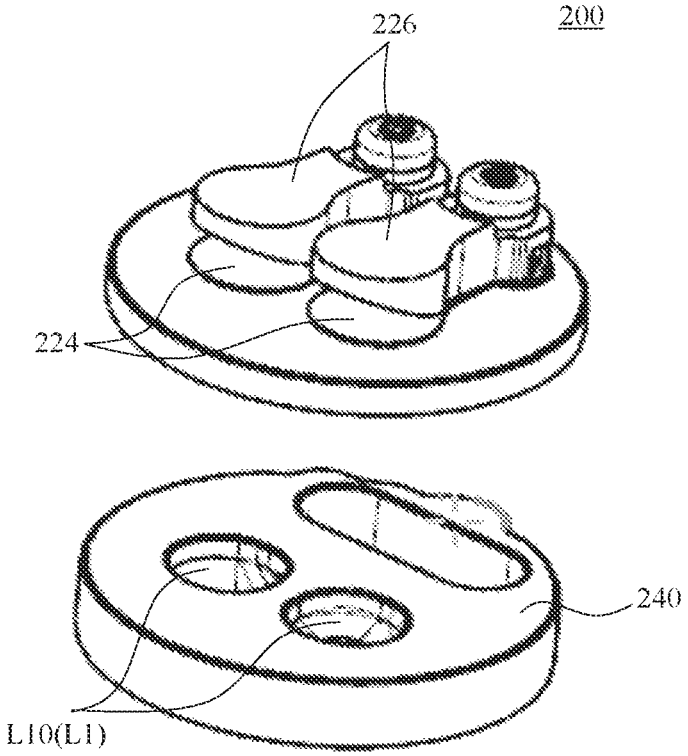

FIG. 3*a* to FIG. 3*b* respectively show the valve assembly in the scroll compressor according to the first preferred embodiment of the disclosure, wherein, FIG. 3*a* shows a longitudinal cross-sectional view of the valve assembly mounted in the scroll compressor in an assembled state; FIG. 3*b* shows a perspective view of the valve assembly in an exploded state.

In general, the valve assembly 200 according to the first preferred embodiment of the disclosure includes: a valve plate 220, which includes two valve holes 222; two valve pieces 224 and two valve stops 226, which are fixed to the valve plate 220 by bolts, each valve piece 224 covers a valve hole 222, wherein the valve piece 224 is an elastic member and covers the valve hole 222 under normal conditions. When the valve piece 224 is subjected to a certain external force—for example, the fluid pressure from the exhaust port V of the compression mechanism CM is greater than a predetermined pressure, the valve piece 224 is elastically deformed away from the valve hole 222. The scroll compressor 100 further includes a guide member 240 independent from the valve plate 220, and the guide member 240 includes a tapered guide passage L, the tapered guide passage L fluidly communicates the valve hole 222 with the exhaust port V, wherein the first port L1 of the tapered guide passage L is aligned with the valve hole 222—preferably, the opening of the first port L1 is greater than or equal to that of the valve hole 222, and more preferably, the opening of the first port L1 and the opening of the valve hole 222 are completely matched in size and shape. The second port L2 of the tapered guide passage L is aligned with the exhaust port V—preferably, the opening of the second port L2 is greater than or equal to that of the exhaust port V, and more preferably, the opening of the second port L2 and the opening of the valve hole 222 are completely matched in size and shape. Moreover, in this embodiment, as the exhaust port V is larger than the flow area of the valve hole 222, preferably, the flow area of the second port L2 is larger than the flow area of the first port L1. It should be noted that the disclosure is not limited to this, According to the variable relation between the flow areas of the exhaust port V and the valve hole 222 (or the sum of multiple valve holes 222), the relation between the flow area of the second port L2 and the flow area of the first port L1 can be changed accordingly. For example, when the exhaust port V is smaller than or equal to the flow area of the valve hole 222 (or the sum of multiple valve holes 222), the flow area of the second port L2 may be smaller than or equal to the flow area of the first port L1.

As shown in FIG. 3*a*, the tapered guide passage L is tapered from the second port L2 to the first port L1, so that the inner wall of the tapered guide passage L is inclined. As a result, the fluid is gradually and transitionally guided to the valve plate 220 from the exhaust port V via the tapered guide passage L, thereby significantly reducing fluid flow resistance and fluid pressure drop, greatly improving exhaust stability. In addition, preferably, as more than one valve hole 222 is provided, more fluid can be discharged when the valve piece 224 is far away from the valve hole 222 by the same distance. As a result, the opening degree and moving speed of the valve piece 224 are reduced, and the service life of the valve piece 224 is significantly prolonged.

Figure 4A:
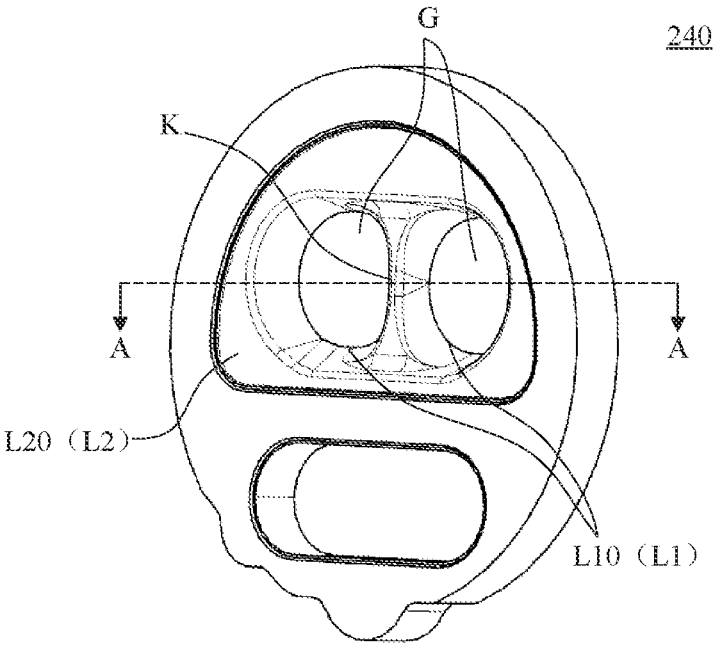
Figure 4B:
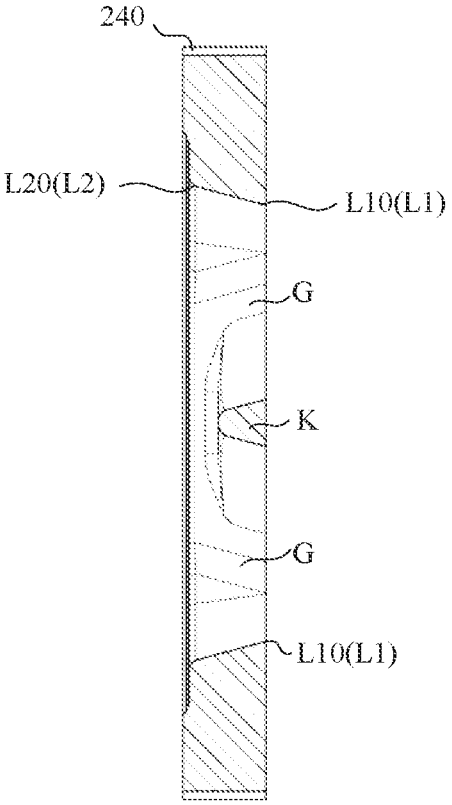
Figure 4C:
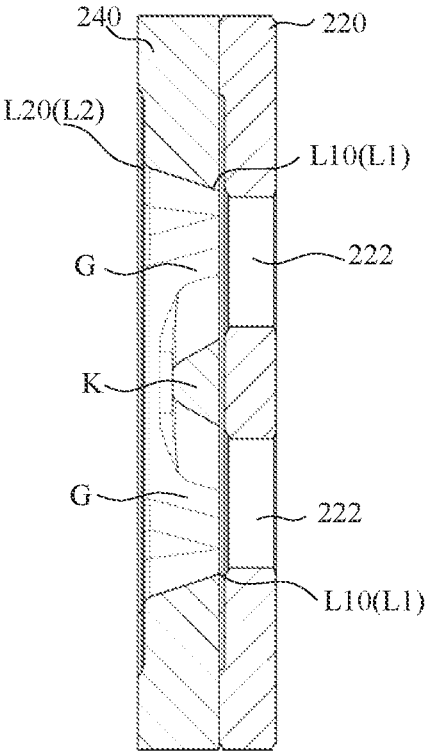

FIG. 4*a* to FIG. 4*c* respectively show the guide member in FIG. 3*b*, wherein FIG. 4*a* shows a perspective view of the guide member; FIG. 4*b* shows a longitudinal cross-sectional view of the guide member in FIG. 4*a* taken along the line A-A; FIG. 4*c* shows an A-A cross-sectional view of the guide member in FIG. 4*b* and the valve plate assembled together. As shown in the figures, in this embodiment, the tapered guide passage L particularly includes two channels G, and each channel G is tapered from the second port L2 to the first port L1. And, each channel G extends to the first port L1 and forms two first orifices L10, the two first orifices L10 are aligned with the two valve holes 222 in one-to-one correspondence and preferably have the same diameter and shape as that of the two valve holes 222 (as shown in FIG. 4*c*). The two channels G are separated from each other by the rib K (the rib K corresponds to the "guide portion" used to separate the two channels G in the guide passage L according to the disclosure, and serves as an example of the "guide portion"), As shown in the figures, the rib K is tapered while extending toward the second port L2 so as to guide the fluid into the two valve holes 222 more moderately, and the rib K ends before it extends to the second port L2, that is, the two channels G are merged into one channel before extending to the second port L2, and finally a larger second orifice L20 is formed at the second port L2, that is, the number of the second orifice L20 is different from the number of the first orifice L10. In this case, the second orifice L20 may better match the exhaust port V in size and shape, and may better guide the fluid.

Figure 5A:
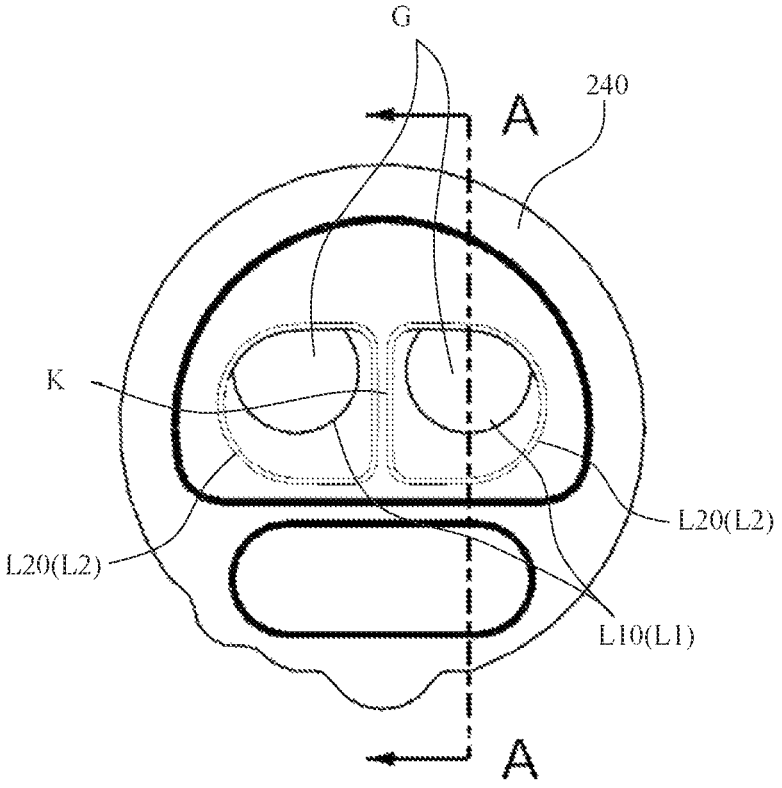
Figure 5B:
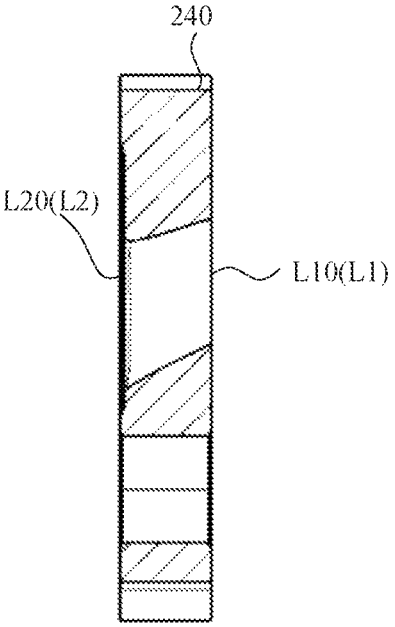
Figure 5C:
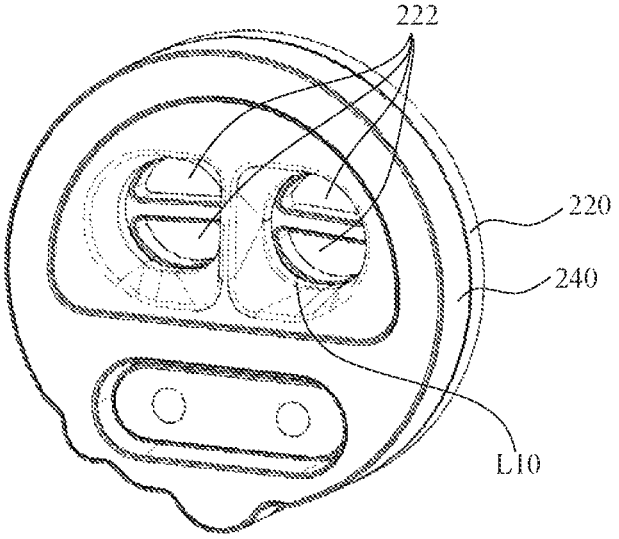
Figure 5D:
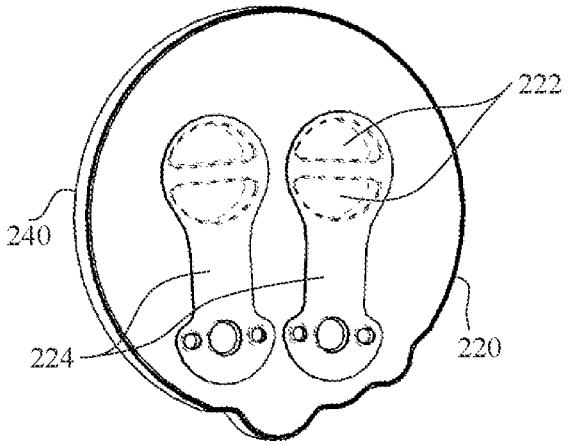
Figure 5E:
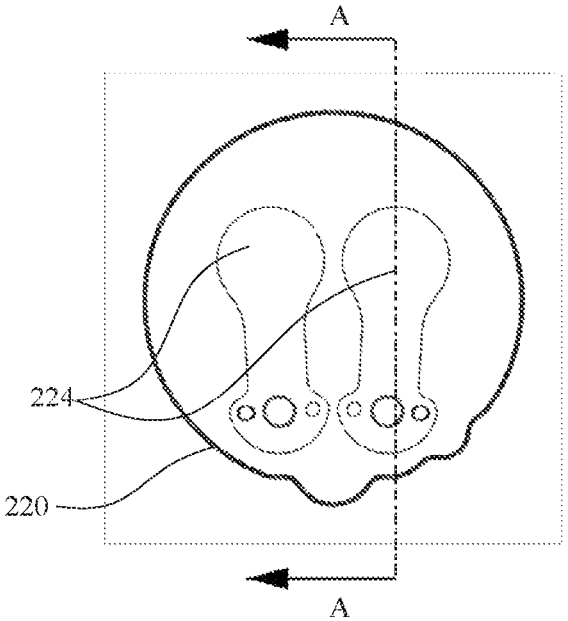
Figure 5F:
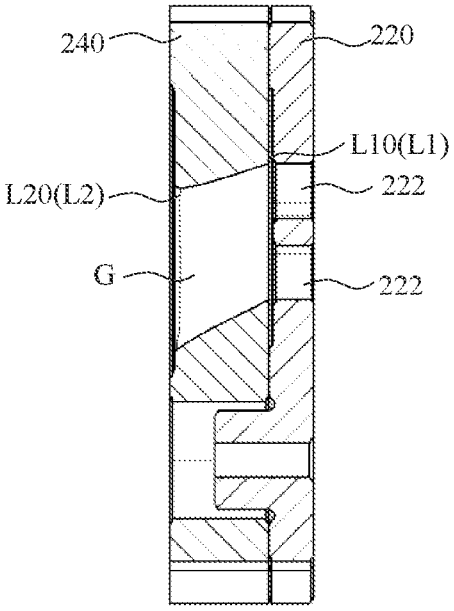

In the above two embodiments, the first orifice L10 and the second orifice L20 are aligned with respect to each other in the longitudinal direction of the scroll compressor. This configuration is mainly aimed at the situation where the exhaust port V of the compression mechanism and the valve hole 222 of the valve assembly 200 are substantially aligned (or slightly deviated) in the longitudinal direction. However, the disclosure is not limited to this. FIG. 5*a* to FIG. 5*f* respectively show a guide member in a valve assembly in a scroll compressor according to a second preferred embodiment of the disclosure, wherein FIG. 5*a* shows a perspective view of the guide member; FIG. 5*b* shows a longitudinal cross-sectional view of the guide member in FIG. 5*a* taken along the line A-A; FIG. 5*c* and FIG. 5*d* show a perspective view of the assembly of the guide member in FIG. 5*b* and the valve plate; FIG. 5*e* shows a plan view of the guide member in FIG. 5*b* and the valve plate assembled together; FIG. 5*f* shows an A-A cross-sectional view of the guide member in FIG. 5*b* and the valve plate assembled together.

In this embodiment, the guide member 240 generally has the configuration of the first embodiment, and the difference lies in that, in the guide member 240, the rib K between the two channels G extends to the second port L2, that is, the two channels G extend to the second port L2 independently from each other, and finally form two second orifices L20 at the second port L2, that is, the number of second orifices L20 is the same as the number of the first orifices L10, and the outer circumference size and shape of the second port L2 constituted by two second orifices L20 are preferably matched with the outer circumference of the exhaust port V; in addition, as better shown in FIG. 5*b* and FIG. 5*c*, the first orifice L10 and the second orifice L20 of each channel G are laterally offset by a certain distance relative to each other—that is, they are not aligned with each other in the longitudinal direction of the scroll compressor. This configuration is mainly aimed at the situation where the exhaust port V of the compression mechanism and the valve hole 222 of the valve assembly 200 are misaligned in the longitudinal direction. In order to better guide the fluid from the exhaust port V into the valve hole 222, it is preferable to arrange the second orifice L20 aligned with the exhaust port V so that the second orifice L20 is offset relative to the first orifice L10 aligned with the valve hole 222. This design further reduces the exhaust resistance and mitigates the pressure drop when the fluid flows through the valve hole, thereby significantly improving the stability of the exhaust flow and further improving the exhaust effect.

On the other hand, each first orifice L10 of the guide member 240 is not limited to be aligned with only one valve hole 222 of the valve plate 220, As shown in FIG. 5*c* to FIG. 5*f*, each first orifice L10 can be aligned with the two valve holes 222 of the valve plate 220, in this case, the valve plate 220 may be provided with four valve holes 222, and every two valve holes 222 are aligned with a first orifice L10 in the guide member 240. In addition, only two valve pieces 224 and two valve stops 226 may still be provided on the valve plate 220. Each valve plate 224 covers two valve holes 222, so as to control the closing and opening of the two valve holes 222 at the same time, thereby saving cost. It is obvious that other numbers of valve holes and other numbers of valve pieces and valve stops may be provided on the valve plate 220 according to different application conditions and requirements. Similarly, each valve piece and valve stop may cover other numbers of valve holes.

Figure 6C:
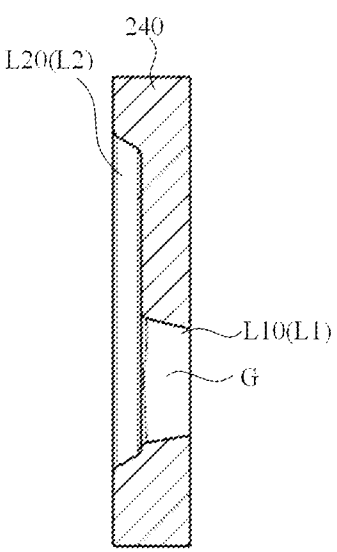
Figure 6B:
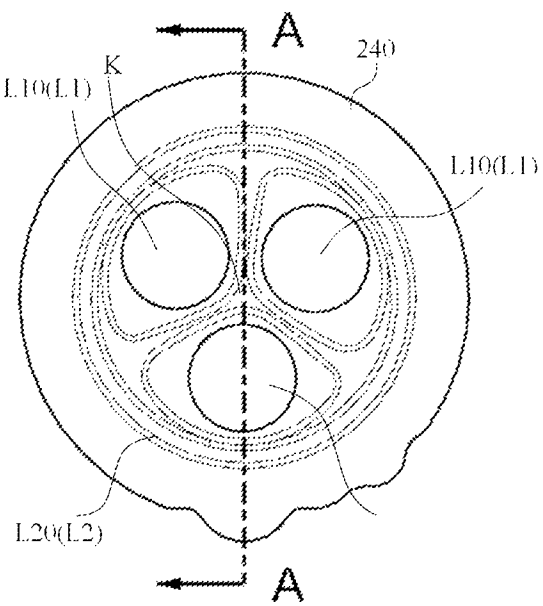
Figure 6A:
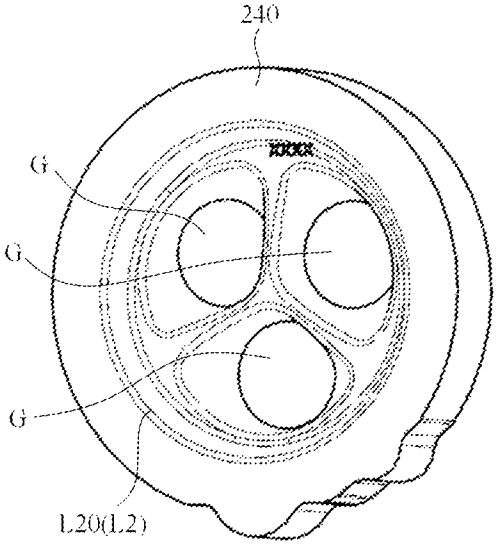

In addition, although the tapered guide passage L of the guide member 240 in the above-mentioned embodiments includes two channels G, the disclosure is not limited to this. FIG. 6*a* to FIG. 6*c* respectively show a guide member in a valve assembly in a scroll compressor according to a third preferred embodiment of the disclosure, where FIG. 6*a* shows a perspective view of the guide member; FIG. 6*b* shows a plan view of the guide member in FIG. 6*a*; FIG. 6*c* shows a longitudinal cross-sectional view of the guide member in FIG. 6*b* taken along the line A-A. As shown in the figure, the three channels G are separated from each other by ribs K, and three first orifices L10 are formed at the first port L1 of the guide member 240. As shown in the figures, the rib K is tapered while extending toward the second port L2, so as to more moderately guide the fluid into the valve hole 222, and the rib K ends before extending to the second port L2. In other words, the three channels G are merged into one channel before extending to the second port L2, and finally a larger second orifice L20 is formed at the second port L2.

Alternatively, the number of first orifices may be different from the number of channels G. That is, the number of first orifices may be greater or less than the number of channels G, Similarly, multiple channels G are merged with each other before extending to the first port L1, thereby forming first orifices at the first port L1, and the number of the first orifices is less than the number of the channels G; on the contrary, each channel G is divided into multiple channels before extending to the first port L1, thereby forming first orifices at the first port L1, and the number of the first orifices is greater than the number of the channels G; alternatively, each channel G may also extend to multiple first orifices. A similar arrangement may also be applied to the second orifice L20 at the second port L2. In addition, at least one of the multiple channels G may be non-tapered and have a constant cross-sectional area. According to actual application requirements, those of ordinary skill in the art may think of various other possible settings for the channel G.

In this case, since there are relatively more channels G, the cross-sectional area of the fluid path of the tapered guide passage L is further enlarged. In this case, more valve holes 222 may be provided on the valve plate 220, for example, three valve holes 222 are provided to match the three first orifices L10 in a manner of one-to-one correspondence. In addition, referring to FIG. 5*c* in the aforementioned second embodiment, more valve holes 222 may also be provided, so that one first orifice L10 corresponds to two, three or more valve holes 222. In this way, the total cross-sectional area of the valve hole 222 on the valve plate 220 is further enlarged, and more fluid may be discharged when the valve piece 224 is the same distance away from the valve hole 222. As a result, the opening degree and moving speed of the valve piece 224 are reduced, and the service life of the valve piece 224 is significantly prolonged.

In the above embodiment, by providing the guide member 240 that includes the aforementioned tapered guide passage L, which is independent from the valve plate 220, the configuration of the tapered guide passage L is set more flexibly. In case of being applied to different types of compressors, the position and/or size of the exhaust port of the compression mechanism relative to the valve hole may be different. In this case, the guide member may be adapted to different types of compressors by replacing the guide member or simply modifying the guide member, which greatly reduces the cost and saves labor.

In addition, in another preferred embodiment not shown according to the disclosure, the valve assembly 200 may not include a separate guide member 240, and the guide member 240 including the aforementioned tapered guide passage L may be integrally formed with the valve plate 220 or the aforementioned tapered guide passage L may be directly provided on the valve plate 220. The tapered guide passages L of the various configurations described above are all applicable to such embodiment.

Figure 7A:
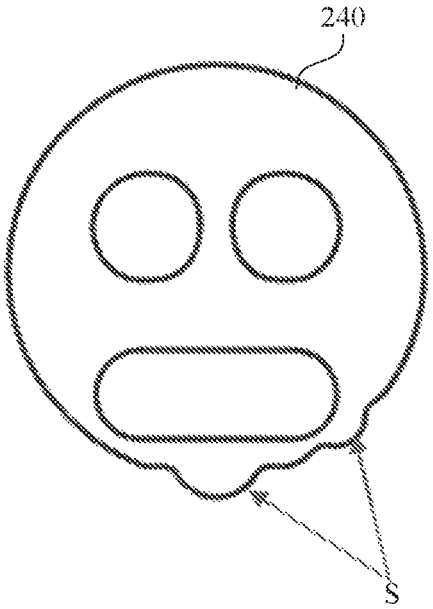
Figure 7B:
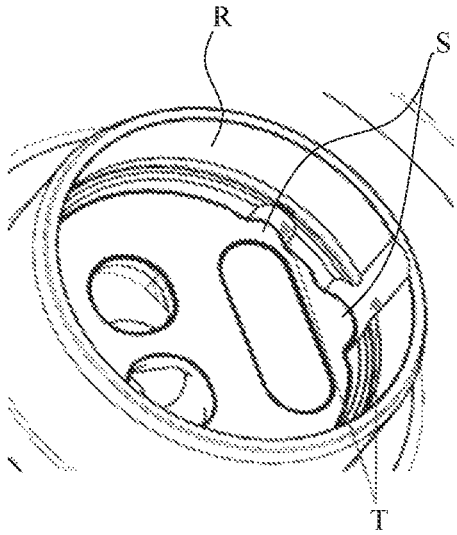
Figure 7C:
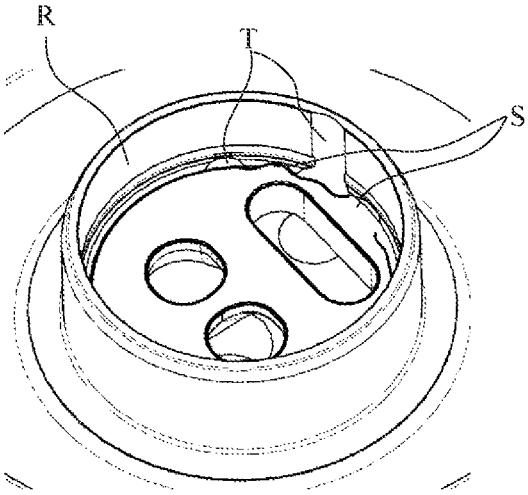
Figure 7D:
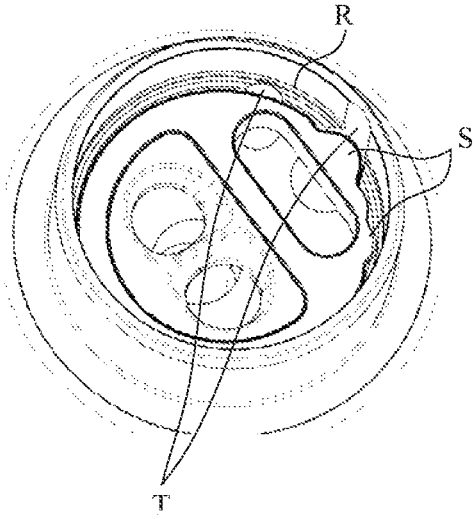

In addition, in order to facilitate the correct installation of the valve assembly into the compressor to ensure the exhaust effect, the guide member 240 may also be provided with an installation positioning indicating portion. For example, FIG. 7*a* to FIG. 7*d* respectively show the guide member in FIG. 3*b*, in which the positioning indicating portion of the guide member and its fitting in the scroll compressor are shown, wherein FIG. 7*a* shows a schematic plan view of the guide member; FIG. 7*b* shows a situation where the guide member in FIG. 7*a* is correctly fitted in the scroll compressor; FIG. 7*c* shows a schematic diagram of the guide member in FIG. 7*a* being incorrectly fitted in the scroll compressor, wherein the guide member is misaligned in the circumferential direction in the scroll compressor; FIG. 7*d* shows a schematic diagram of the guide member in FIG. 7*a* being incorrectly fitted in the scroll compressor, where the guide member is turned over and assembled in the scroll compressor.

In this embodiment, as shown in the figures, the guide member 240 includes a positioning indicating portion S, the positioning indicating portion S preferably includes two convex portions arranged in non-centrosymmetric way along the outer circumference of the guide member 240. Referring to FIG. 3*a*, the valve assembly 200 is disposed in the concave portion R defined by the hub portion of the end plate of the fixed scroll 22 of the compression mechanism CM. Correspondingly, the inner side wall of the concave portion R is provided with a shape fitting portion T that matches the positioning indicating portion S of the guide member 240 in a manner of one-to-one correspondence. Preferably, in this embodiment, the shape fitting portion T is two grooves located on the inner side wall of the concave portion R. As shown in FIG. 7*b*, the guide member 240 in FIG. 7*a* is correctly fitted in the concave portion R defined by the hub portion of the end plate of the fixed scroll 22 of the compression mechanism CM. The positioning indicating portion S (two convex portions) and the shape fitting portion T (two grooves) are matched in a manner of one-to-one correspondence. FIG. 7*c* shows a schematic diagram of the guide member 240 in FIG. 7*a* being incorrectly fitted in the concave portion R defined by the hub portion of the end plate of the fixed scroll 22 of the compression mechanism CM, wherein the guide member 240 is misaligned in the concave portion R in the circumferential direction, that is, the positioning indicating portion S (two convex portions) and the shape fitting portion T (two grooves) are not aligned one to one, so that the positioning indication portion S (two convex portions) collides with the inner side wall of the concave portion R and prevents the guide member 240 from being mounted in the concave portion R. Another example, FIG. 7*d* shows a schematic diagram of another misfitting situation of the guide member 240 in FIG. 7*a* in the concave portion R, wherein the guide member 240 is turned over and fitted in the concave portion R, so that the first port L1 of the tapered guide passage L faces the exhaust port V, and the second port L2 of the tapered guide passage L faces the valve hole 222 of the valve plate 220. In this case, similarly, the positioning indicating portion S (two convex portions) collides with the inner side wall of the concave portion R and prevents the guide member 240 from being fitted into the concave portion R.

It can be seen that by setting the above-mentioned two convex portions which are arranged in non-centrosymmetric way along the outer circumference of the guide member 240 as the positioning indicating portion S, the guide member 240 may only be mounted with the joint portion of the compressor under the only specific and correct fitting condition. However, the guide member cannot be mounted with the joint portion of the compressor under any other incorrect fitting conditions. Therefore, the guide member is effectively prevented from being mounted incorrectly and affecting the exhaust effect.

In addition, at least one positioning indicating portion with other irregular shapes may also be adopted. For example, in the case where only one positioning indicating portion is provided, the positioning indicating portion itself may have a non-centrosymmetric shape, and may be a convex portion or a concave portion. Correspondingly, the joint portion in the compressor has a concave portion or convex portion that matches in shape and is also non-centrosymmetric. In this way, when the operator tries to mount the guide member in an inverted state (incorrectly fitted) into the concave portion R defined by the hub portion of the end plate of the fixed scroll 22 of the compression mechanism CM, for example, since the positioning indication portion (and the shape fitting portion on the concave portion R) itself has a non-centrosymmetric shape, the reversed positioning indication portion and the shape fitting portion collide with each other, and the guide member cannot be mounted in the scroll compressor. Obviously, this configuration may also achieve the technical object of preventing the guide member from being mounted incorrectly.

In addition, although the above preferred embodiments all define the tapered guide passage L, the disclosure is not limited to this, in a preferred embodiment not shown according to the disclosure, in view of the fact that the exhaust port V of the compression mechanism has substantially the same size as at least one valve hole of the valve plate, the guide passage L may not have a tapered shape at this time, but has a substantially constant cross-sectional area. The guide passage L may also include multiple channels G as defined in the previous embodiments, the channels G may be tapered as described above and/or have a constant cross-sectional area. In addition, in the case that the exhaust port V is completely aligned with at least one valve hole of the valve plate in the longitudinal axis direction of the scroll compressor, this guide passage L may also extend parallel to the longitudinal axis.

On the other hand, in order to overcome the problem that the exhaust port V is not completely aligned with at least one valve hole of the valve plate in the longitudinal axis direction of the scroll compressor, the inner wall of the guide passage L may extend from the second port to the first port in an inclined manner with respect to the longitudinal axis of the compressor, and the guide passage L has a constant cross-sectional area, so as to guide the fluid. In this case, the entire inner wall of the guide passage is inclined in the same direction with respect to the longitudinal axis of the compressor.

On the other hand, only one side of the inner wall of the guide passage L in the direction transverse to the longitudinal axis of the scroll compressor may be made parallel to the longitudinal axis, and the inner wall of the remaining part is inclined with respect to the longitudinal axis. For example, in a case where the exhaust port V of the compression mechanism and at least one valve hole of the valve plate are different in size but the edges on the same side of each other are aligned along the longitudinal axis without offset, in order to completely guide the fluid from the exhaust port V into the valve hole, the second port L2 of the guide passage L needs to be larger than the first port L1, and the inner wall of the guide passage L on the same side in the direction transverse to the longitudinal axis of the scroll compressor is made parallel to the longitudinal axis, and the inner wall of the remaining part is inclined with respect to the longitudinal axis of the compressor, so as to guide the fluid.

In addition, it should be further explained that "incline" and "taper" defined in this specification include various possible embodiments, specifically, for example, it includes preferred continuous, smooth inclinations and possibly stepped inclinations. The stepped inclination may include a stepped way with a partially step-like or curved concave-convex structure, and covers the case of partial non-inclination, as long as it makes at least a part of the inner wall of the guide passage L extend from the second port to the first port in an inclined manner with respect to the longitudinal axis of the compressor as a whole.

Although the exemplary embodiments of the scroll compressor according to the disclosure are described in the above embodiments, the disclosure is not limited thereto, but various modifications, replacements and combinations can be performed without departing from the protection scope of the disclosure.

Apparently, various implementations can be further designed by combining or modifying different embodiments and each technical feature in different ways.

The scroll compressors according to the preferred embodiments of the disclosure are described above in conjunction with the specific implementations. It can be understood that, the above description is merely exemplary rather than restrictive, and those skilled in the art can conceive various variations and modifications without departing from the scope of the disclosure with reference to the above description. These variations and modifications shall still fall into the protection scope of the disclosure.

The invention claimed is:

1. A scroll compressor, comprising:

a compression mechanism provided with an exhaust port; and a valve assembly being used to selectively open and close the exhaust port, and the valve assembly comprising:

a valve plate comprising at least one valve hole; and at least one valve piece configured to selectively open and close the valve hole, wherein the scroll compressor further comprises a guide passage which has a first port communicating with the valve hole and a second port communicating with the exhaust port, and wherein the guide passage is configured as a tapered guide passage that tapers from the second port to the first port, the guide passage tapers along the entire axial distance between the second port and the first port.

2. The scroll compressor according to claim 1, wherein a flow area of the second port and a flow area of the first port are not equal.

3. The scroll compressor according to claim 1, wherein an inner wall of the guide passage is at least partially continuously inclined with respect to a longitudinal direction of the scroll compressor.

4. The scroll compressor according to claim 1, wherein an inner wall of the guide passage has a locally stepped or curved concave-convex structure.

5. The scroll compressor according to claim 1, wherein an area of the first port is greater than or equal to an area of the valve hole, and/or an area of the second port is greater than or equal to an area of the exhaust port.

6. The scroll compressor according to claim 1, wherein the second port and the first port are aligned with each other in a longitudinal direction of the scroll compressor; or, the second port and the first port are not aligned with each other in the longitudinal direction of the scroll compressor.

7. The scroll compressor according to claim 1, wherein the first port comprises at least one first orifice, and the number of the at least one first orifice corresponds to the number of the at least one valve hole; or, the first port comprises at least one first orifice different in number from the at least one valve hole.

8. The scroll compressor according to claim 7, wherein the second port comprises at least one second orifice, and the number of the at least one second orifice is the same as the number of the at least one first orifice; or, the second port comprises at least one second orifice different in number from the at least one first orifice.

9. The scroll compressor according to claim 8, wherein the first port comprises two first orifices, and the second port comprises one second orifice, the valve plate comprises two valve holes respectively communicating with the two first orifices, the guide passage is configured as a tapered guide passage that tapers from the second orifice to the first orifice.

10. The scroll compressor according to claim 1, wherein the scroll compressor comprises a guide member provided between the valve plate and the exhaust port, and the guide passage is provided in the guide member.

11. The scroll compressor according to claim 10, wherein the valve assembly is disposed in a concave portion defined by a hub portion of a fixed scroll end plate of the compression mechanism, an inner side wall of the hub portion is provided with a shape fitting portion that matches a positioning indicating portion provided on an outer circumference of the guide member in a manner of one-to-one correspondence.

12. The scroll compressor according to claim 11, wherein the positioning indicating portion comprises at least two convex portions arranged in a non-centrosymmetric way along the outer circumference of the guide member, and the shape fitting portion comprises at least two grooves.

13. The scroll compressor according to claim 1, wherein the number of the valve hole is at least two, and the number of the valve piece is equal to the number of the valve hole, so that one of said valve pieces covers respective one of said valve holes.

14. The scroll compressor according to claim 1, wherein at least one valve stop is further fixed on the valve plate, and the valve stop is located on the side of the valve piece facing away from the valve plate and has a gap with the valve piece to define the distance of the valve piece away from the valve hole.

* * * * *